US008519572B2

(12) United States Patent
Zhong et al.

(10) Patent No.: US 8,519,572 B2
(45) Date of Patent: Aug. 27, 2013

(54) SELF POWER-ACQUIRING QUICK-RESPONSIVE CONTROLLABLE REACTOR

(75) Inventors: Juntao Zhong, Liaoning (CN); Zhen An, Liaoning (CN); Haiting Zhang, Liaoning (CN)

(73) Assignee: Tbea Shenyang Transformer Group Co., Ltd, Shenyang, Liaoning (CN)

( * ) Notice: Subject to any disclaimer, the term of this patent is extended or adjusted under 35 U.S.C. 154(b) by 416 days.

(21) Appl. No.: 12/999,483

(22) PCT Filed: Jun. 27, 2008

(86) PCT No.: PCT/CN2008/071472

§ 371 (c)(1),
(2), (4) Date: Dec. 16, 2010

(87) PCT Pub. No.: WO2009/152662

PCT Pub. Date: Dec. 23, 2009

(65) Prior Publication Data

US 2011/0089770 A1 Apr. 21, 2011

(30) Foreign Application Priority Data

Jun. 18, 2008 (CN) ..... 2008 1 0011902

(51) Int. Cl.
*H01F 27/42* (2006.01)

(52) U.S. Cl.
USPC ..... 307/412

(58) Field of Classification Search
USPC ..... 307/412; 361/33–35, 139, 144, 361/160, 268
See application file for complete search history.

(56) References Cited

U.S. PATENT DOCUMENTS

2005/0083617 A1* 4/2005 Blumenauer et al. ..... 361/42

FOREIGN PATENT DOCUMENTS

| | | |
|---|---|---|
| CN | 1790565 | 6/2006 |
| CN | 1901107 | 1/2007 |
| CN | 1933056 | 3/2007 |

OTHER PUBLICATIONS

English language International Search Report for PCT/CN2008/071472 mailed Apr. 2, 2009.

* cited by examiner

*Primary Examiner* — Jared Fureman
*Assistant Examiner* — Duc M Pham
(74) *Attorney, Agent, or Firm* — Smith, Gambrell & Russell, LLP

(57) ABSTRACT

This invention relates to a self power-acquiring quickly responsive controllable reactor whose coil of the main body portion contains a control winding (6), a net-side winding (5), further contains a tertiary winding (7). The tertiary winding (7), the control winding (6) and the net-side winding (5) are set in turn on a magnetic conductive core column of the main body portion (1) from inside to outside; the net-side winding (5) has power-acquiring taps; which connect with the primary coil of rectiformer in a rectifying-filtering unit (2). The output terminals of the rectifying-filtering unit (2) connect with the control winding (6). A quick switch (K) is in parallel connected with the tertiary winding (7). The on/off state of the quick switch (K) is controlled by the command transmitted by the control unit (4) in the controllable reactor. This invention uses an additional tertiary winding to control the power system through the high speed switch and the control unit in the case of short circuit to meet the quick response when the controllable reactor is in fault. Moreover, this controllable reactor has an excellent obtaining effect and wide applications.

3 Claims, 3 Drawing Sheets

SELF POWER-ACQUIRING QUICK-RESPONSIVE CONTROLLABLE REACTOR

FIELD OF THE INVENTION

This invention relates to a controllable reactor, in particular, it is the self power-acquiring quick-responsive controllable reactor through net-side winding to achieve reactance and capacity control.

BACKGROUND OF THE INVENTION

In current power grid, when the system breaks down (e.g. single phase-to-ground fault), it is required for the controllable reactor functioning on the power grid to quickly increase the capacity to its nominal capacity and control the response speed within 100 ms with capacity not exceeding the nominal capacity of the controllable reactor so as to meet the requirement of inhibiting overvoltage and secondary arc current. However, current technology fails to satisfy such requirement (i.e. quick-response). At present, there are three ways for DC excitation system to obtain power: 1. external power source; 2. compensation winding; and 3. control-winding. If the controllable reactor does not have a reliable external power source, it is necessary to obtain power from itself. The disadvantage for self-feeding controllable reactor to obtain power through control-winding is that it will generate a large amount of harmonic wave, along with decline of the primary voltage of the rectifier unit with the increase of saturation level of the reactor, while by using compensation winding it can successfully control the amount of the harmonic wave, but it also has the problem with decline of the primary voltage.

SUMMARY OF THE INVENTION

This invention provides a self power-acquiring quick-responsive controllable reactor by arming at solving the technical problem of overcoming the weakness of low response speed and power obtaining method of control winding.

In order to realize the aim of the invention, the technology adopted in this invention is as follows:

A coil in a main body portion of the self power-acquiring quick-responsive controllable reactor contains a net-side winding, a control winding, and further contains a tertiary winding, the tertiary winding, the control winding and the net-side winding are set in turn on a magnetic conductive core column of the main body portion from inside to outside. Wherein the net-side winding has power-acquiring taps; a quick switch is in parallel connected with the tertiary winding, which is controlled by the command transmitted by a control unit in the controllable reactor.

The power-acquiring taps of the net-side winding are connected with the primary coil of the rectiformer in a rectifying-filtering unit of the controllable reactor. The output terminal of the rectifying-filtering unit connects with the control winding. The magnetic conductive core column have the following structures selected from the group consisting of single-phase two-limb, single-phase and single synthetic limb, single-phase and three synthetic limbs, two-limb three-phases, or three-phase six-limb.

The invention has the following benefits and advantages:

1. Flexible control with quick responsive time. Controllable reactor having an additional tertiary winding is controlled through a quick switch and a control unit in the case of short circuit so as to meet the requirements of the quick response (response time: within 100 ms).
2. Excellent power obtaining effect. Controllable reactor set a net-side winding to obtain the excitation power itself for the DC excitation system including rectifying-filtering unit and the control winding when external power source is unusable; adjust reactance (smooth adjustment of capacity from 1-100%) by adjusting the DC excitation current. It can not only smoothly adjust the reactive power to achieve flexible current transmission but also inhibit power frequency/overvoltage and decrease line losses to greatly enhance the stability and security of the system.
3. Wide range of applications. This invention, applied to power system from 110 kv (or above) to UHV, is an important reactive power compensatory device.

DESCRIPTION OF THE PREFERRED EMBODIMENT

Figure 1:
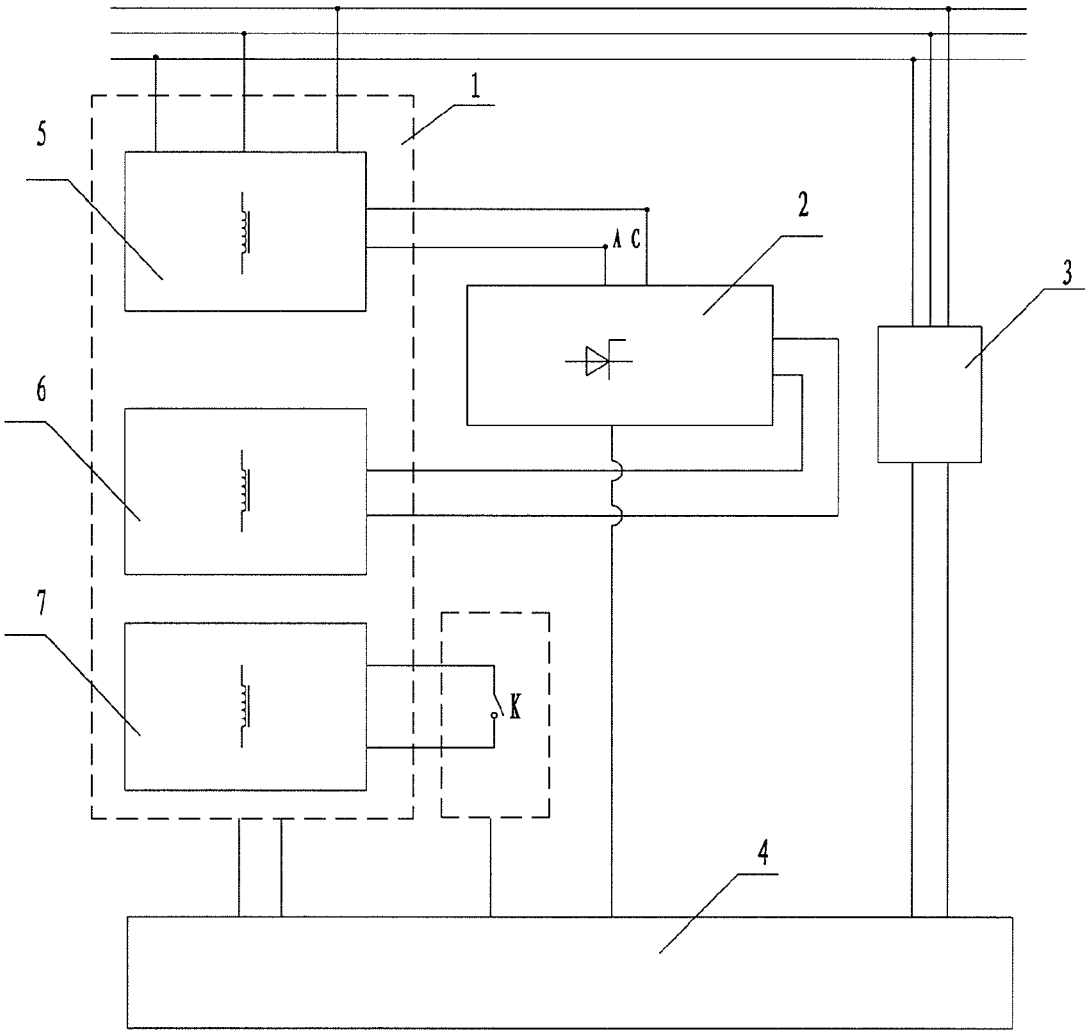
FIG. 1 is the structure principle drawing of the invention.

For details see the FIG. 1. The main body portion 1 of the self power-acquiring quick-responsive controllable reactor is immersed inside oil tank. The coil of the main body portion 1 contains the net-side winding 5 and the control winding 6 as well as further including the tertiary winding 7, the tertiary winding 7, the control winding 6 and the net-side winding 5 are set in turn on the magnetic conductive core column of the main body portion 1 from inside to outside. The tertiary winding 7 is connected with the control unit and the detecting unit in the controllable reactor by the quick switch K. The net-side winding 5 has power-acquiring taps, the rectifying-filtering unit 2 of the controllable reactor connects to the power-acquiring taps of the net-side winding 5, and the output terminal of the rectifying-filtering unit 2 is connect to the control winding 6. In another example, without the rectifying-filtering unit 2, the control winding 6 is connected with the net-side winding 5 through the power-acquiring taps directly.

Figure 2:
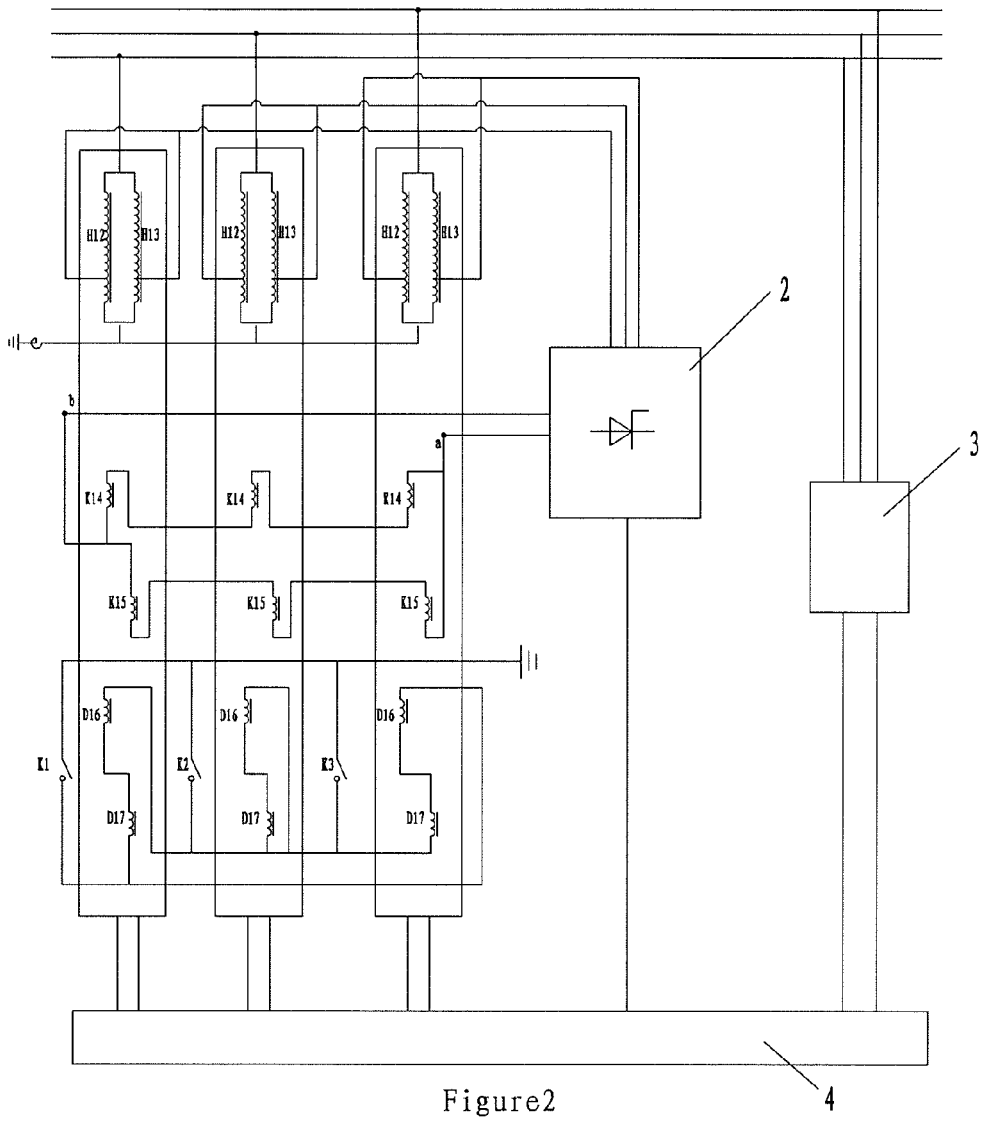
FIG. 2 is the schematic circuit diagram of one sample.
Figure 3:
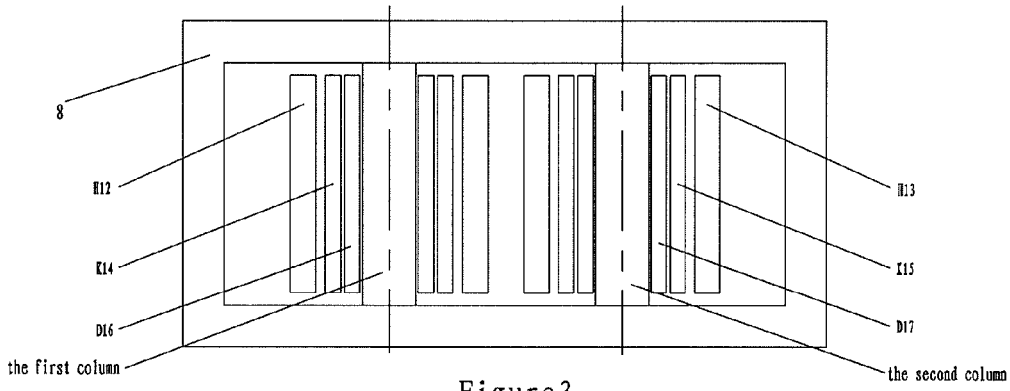
FIG. 3 is schematic of the iron core and coil in the main body portion.
Figure 4:
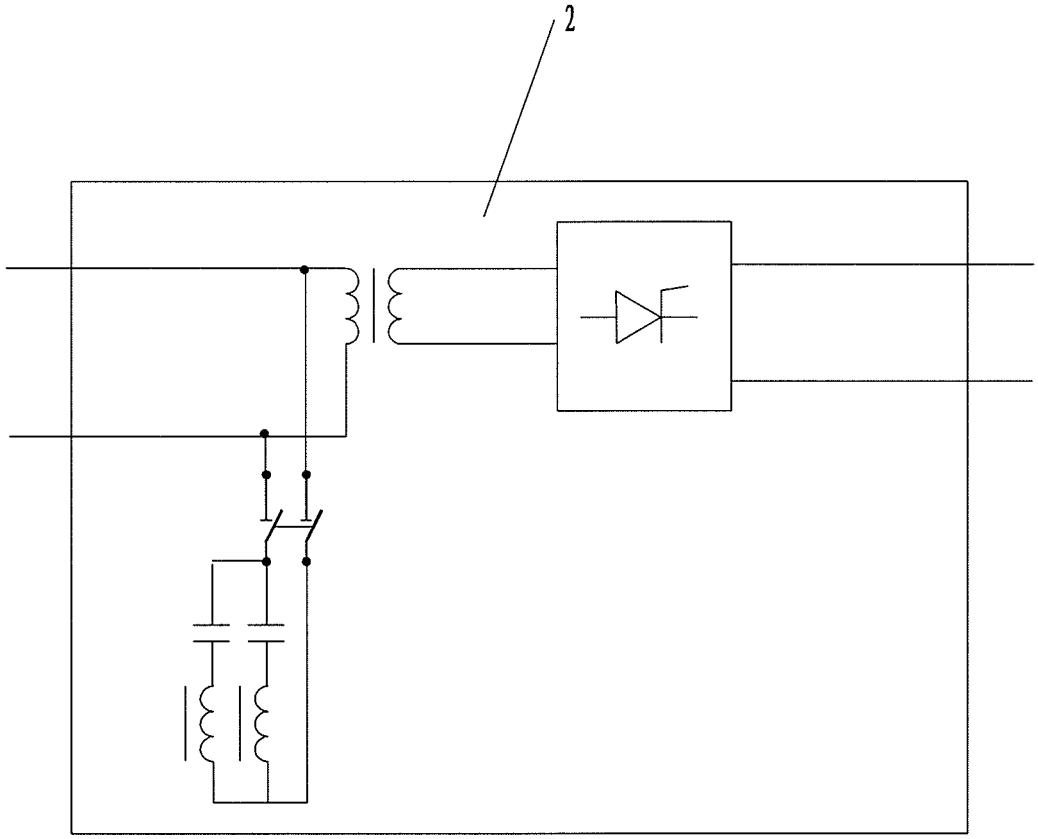
FIG. 4 is electrical schematic drawing of the rectifying-filtering unit.

For details see FIG. 2 and FIG. 3, in one example of the invention, the magnetic conductive core column immersed inside the oil tank is of the structure having the single-phase double-limb core, that is to say, the first limb and the second limb form the left and right magnetic yokes, and the top and bottom magnetic yokes of the magnetic circuit. Wherein, the tertiary winding 7, the control winding 6, and the net-side winding 5 are set in turn on the magnetic conductive core column from inside to outside to form the main body portion 1 of the controllable reactor. The primary coil of the net-side winding 5 connects with the transmission line and the power-acquiring taps of the net-side winding 5 connect to the control winding 6 through the rectifying-filtering unit 2. The tertiary winding 7 connects with the quick switch K. The control unit 4 connects with the controllable silicon in the rectifying-filtering unit 2, the quick switch K, the output terminal of the detecting unit 3, and the terminal box connected with various sensor signals of the main body portion 1. The detecting unit 3 comprising of the voltage sensor, current sensor, temperature sensor, light/heavy gas sensor, pressure sensor, and the terminal box for leading out the sensor signals; the input terminal of the detecting unit 3 is also connected with the transmission line.

For details see FIG. 2, the reactor of the invention is a three-phase reactor comprising of three single-phase reactors as example . The net-side winding 5 of each phase comprising of coil $H_{12}$ and coil $H_{13}$ which are connected in parallel. The control winding 6 of each phase comprising of coil $K_{14}$ and coil $K_{15}$. Separate coils of three-phase with the same name are connected from end to end to form a series branch, and two series branches connect again in parallel. The parallel ends called "a" and "b" are connected with each output terminal of the rectifying-filtering unit 2. One end of the coil $H_{12}$ and $H_{13}$ of the net-side winding 5 after connection in star is connected with the three phase transmission line, and the other end of the coil $H_{12}$ and $H_{13}$ connects with a small reactor whose other end connects to the ground. The small neutral reactor is mainly used in the power transmission system to inhibit overvoltage in the case of failure and secondary arc current in short circuit. The system does not need to be equipped with such small reactor, when a magnetically controlled reactor is used on the bus line. The power-acquiring tap of the net-side winding 5 is connected with the rectifying-filtering unit 2, the controllable silicon group of the rectifying-filtering unit 2 connect with the control unit 4. The detecting unit 3 used to examine the power parameters are connected with the transmission line and its output end with power parameters connects with the control unit 4, which is connected with the output terminals of the three single-phase reactors' second-signal terminal box. Wherein the said second-signal includes current signal, temperature signal, light/heavy gas signal, and pressure relief valve protection signal, of which output signals are connected with the input terminal of the terminal box. The iron core of each reactor in the example uses single-phase two-limb/return yokes core. FIG. 3 shows how the iron core and the coil are connected. The surface of the iron core column is covered in turn with coils $D_{16}$, $K_{14}$, and $H_{12}$ from inside to outside on each magnetic conductive core column (i.e. the first column) and the other magnetic conductive core column (i.e. the second column) is covered in turn with coils $D_{17}$, $K_{15}$, and $H_{13}$ from inside to outside. The net-side winding and the control winding can be connected in series or in parallel, and the single phase module of the tertiary winding is in series.

The primary coil in rectiformer of the rectifying-filtering unit 2 is connected with the power-acquiring taps of the net-side winding. The primary coil of the rectiformer and power-acquiring taps connect with a wave filter in parallel and the secondary coil of the rectiformer connects with the controllable silicon group. The rectiformer and the controllable silicon group achieve the rectification; the wave filter including a capacitor and a inductance, the filtered wave is achieved by the capacitor and the inductance, connects with the primary coil of the rectiformer in parallel. The wave filter can be one of third- harmonic filter, 5th-harmonic filter, and high harmonic filter, or the combination thereof.

The detecting unit 3 is used to detect the voltage, current, reactive power, and active power of the power grid.

The control unit 4 comprising of a data collection cabinet, local work station, protection control cabinet, operation cabinet and transient fault recorder cabinet which is used to control the thyristor's trigger angle of the rectifying-filtering unit 2 through the parameter changing of the power grid and the signals (e.g. voltage/current/temperature signals) collected from the main body portion 1 to alter the DC current of the control winding 6. That is to say that providing the alternating current power obtained by the power-acquiring taps of the net-side winding to the rectifying-filtering unit 2. The rectifying-filtering unit 2 will adjust the AC current to DC current, the control unit 4 will automatically control the thyristor's trigger angle (0-180°) of the rectifying-filtering unit 2 according to the changing of the voltage, the reactive and active power detected by the detecting unit 3 to change the value of the DC current, that is, by changing the DC excitation current of the control winding 6 of the reactor's iron core, to control the saturation level and to change the magnetic conductivity of the iron core. In other words, it is to change the reactance value and capacity of the reactor.

When the system is in faulty state, the tertiary winding 7 will control the quick switch K to close rapidly, thus achieve short-circuit of the tertiary winding and meanwhile shut down the DC excitation system (including the rectifying-filtering unit 2, the control winding 6). The tertiary winding 7 instead of the control winding 6 will operates but under normal working conditions, the control winding 6 will be in work normally. The quick switch K meets the requirements of quick response under the controllable reactor in fault (response time within 50 ms)

When the controllable reactor is in normal working conditions (i.e. stable adjustment process), the quick switch K is in the on position, the tertiary winding 7 is not working while the DC excitation system will do. When the detecting unit 3 detects the fault detection existed in the power system, immediately the control unit 4 will send instructions to enable the quick switch K to close to make the tertiary winding 7 short circuit. In this condition, there will be short circuit impedance between the net-side winding 5 and the tertiary winding 7, which makes the controllable reactor reach to a certain inductance value. When the detecting unit 3 detects the failure signal (e.g. single-phase earth fault, three-phase voltage or current imbalance), the DC excitation system will quit immediately, which means that the control unit send control signals to quickly shut down the thyristor's trigger angle to make the thyristor in non-conducting state. At that time, the DC excitation current is zero and the control-winding is not work.

The quick switch can be high voltage sulphur hexafluoride circuit-breaker with model LW24-40.5 to meet requirements of quick response under the controllable reactor in fault, response time is within 50 ms.

What is the claim is:

1. A self power-acquiring quickly responsive controllable reactor, including a main body portion, wherein a coil in the main body portion contains a control winding, a net-side winding, the coil further contains a tertiary winding, wherein the tertiary winding, the control winding and the net-side winding are set in turn on a magnetic conductive core column of the main body portion from inside to outside; the net-side winding has power-acquiring taps; a quick switch is in parallel connected with the tertiary winding; the on/off state of the quick switch is controlled by a command transmitted by a control unit in the controllable reactor.

2. The controllable reactor according the claim 1, wherein the controllable reactor includes a rectifying-filtering unit, the power-acquiring taps of the net-side winding are connected with a primary coil of a rectiformer in the rectifying-filtering unit, and an output terminal of the rectifying-filtering unit is connected with the control winding.

3. The controllable reactor according to claim 1, wherein the magnetic conductive core column is selected from the group consisting of single-phase two-limb core, single-phase and single synthetic limb core, single-phase and three synthetic limbs core, two-limb three-phases core, and three-phase six-limb core.

* * * * *